United States Patent [19]

Santucci

[11] 4,099,546

[45] Jul. 11, 1978

[54] DEVICE FOR VARYING THE BEATING-UP POSITION OF THE REED OF A TEXTILE LOOM FOR TURKISH TOWELLING

[75] Inventor: Nicola Santucci, Schio (Vicenza), Italy

[73] Assignee: Nuovo Pignone S.p.A., Italy

[21] Appl. No.: 744,107

[22] Filed: Nov. 22, 1976

[30] Foreign Application Priority Data

Dec. 11, 1975 [IT] Italy ..... 30194 A/75

[51] Int. Cl.[2] ..... D03D 39/22

[52] U.S. Cl. ..... 139/27

[58] Field of Search ..... 139/25, 26, 27, 188 A

[56] References Cited

U.S. PATENT DOCUMENTS 1,591,912 7/1926 Brown ..... 139/27

FOREIGN PATENT DOCUMENTS 165 of 1900 United Kingdom ..... 139/27

*Primary Examiner*—Henry S. Jaudon

*Attorney, Agent, or Firm*—Morgan, Finnegan, Pine, Foley & Lee

[57] ABSTRACT

In a loom for Turkish towelling, a device is disclosed for varying the beating-up position of the reed, said device essentially comprising a set of feelers mounted on the hinged loom reed and which are constantly in contact with a set of forked profiles mounted on the loom frame, the forked profiles being adjustable as to their positions by specially provided control members. The control members essentially consist of a set of eccentrics keyed onto a single shaft which is driven by a control cam. This arrangement reduces the parts having a reciprocal motion to a minimum and prevents bumps and consequent breakage occurences.

4 Claims, 2 Drawing Figures

Figure 1:
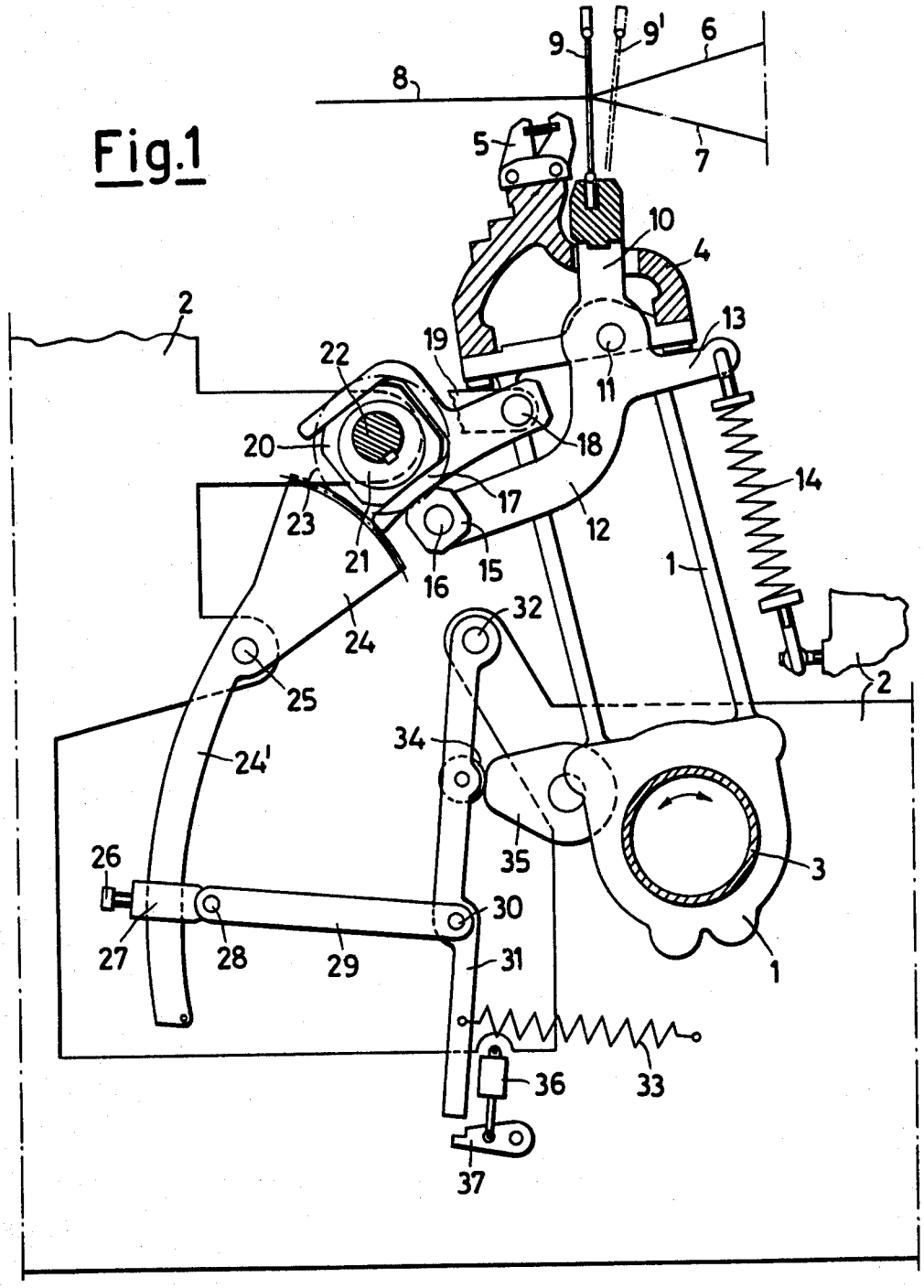

DEVICE FOR VARYING THE BEATING-UP POSITION OF THE REED OF A TEXTILE LOOM FOR TURKISH TOWELLING

This invention relates to a device for varying the beating-up position of the reed of a textile loom for the manufacture of Turkish towelling.

As is known, the formation of the terry in Turkish towelling is obtained by having the reed of the textile loom beating up against the edge of the already formed fabric, after three or four pickings. Stated another way, two or three consecutive weft threads are picked in the respective sheds and then carried by the reed, which is rotated integrally with the loom sley in the vicinity of the edge of the already woven fabric without being beaten up thereagainst. Only after a subsequent weft thread has been picked in its shed, the reed beats up all these picked weft threads against said edge of the already woven fabric.

From the foregoing, it can thus be understood that the reed must be capable of being brought to two different beating up positions relative to the edge of the already woven fabric or in other words the picked weft threads are either brought to, or beaten against, the fabric edge.

In the conventional prior art, different systems and devices are known, which are adapted to vary the position of beating up of a reed in order to have the reed beating up in proper fashion after a number of pickings of weft threads has been completed.

According to one of such conventional approaches, the reed is rigidly mounted on the loom sley and thus carries out oscillations having a constant amplitude, which are adapted only to approach the reed to the edge of the already woven fabric, the latter being supported, in its turn, along with the warp threads, by translatable members.

As the reed is to beat up the picked weft threads against the fabric edge, the latter is translated towards the reed and acts upon said supporting members.

Such an arrangement, however, in addition to being cumbersome and conducive to functional troubles for the warp threads, which must also be translated, involves unsatisfactory wear and a proneness to fraying of the warp of the fabric, on account of the frequent translation it must undergo.

According to another conventional approach, the reed is hinged to the loom sley and is held by a spring in a position as a result of which, due to the effect of the oscillations of the sley, the reed carries out only the movement of approaching the picked weft threads to the edge of the already woven fabric.

As the weft threads must be beaten up, the reed is rotated forwards toward the fabric edge and against the bias of said spring, by a hook which, by being rotated by a control cam on the path of the hinged reed, hooks-up a pin projecting from a reed's arm.

This second arrangement, even though it does away with the drawbacks of the previously cited arrangement since, now, the fabric must no longer be displaced, is, nevertheless, a cause of frequent breakages due to the bumps between being hook and the reed pin, such blows being the more violent, the higher the working speed of the loom.

An object of the present invention is to do away with the above enumerated defects while providing a device for varying the beating-up position of the reed of a textile loom in order to obtain the formation of the terry for Turkish towelling, said device being reliable in operation without blows, even at the high speeds at which the present-day textile machines are operated, and without requiring any displacements of the already woven fabric and of the warp threads.

This object is achieved by means of one of the features of the present invention. Accordingly, the reed hinged to the loom sley is equipped with a set of feelers which are held, by the bias of springs, into constant contact with a set of forked profiles, the latter being hinged to the fixed frame of the textile loom and susceptible of being adjusted as to their positions by special control members.

As a result, there are no more bumping members and the variation of the position of beating up of the reed is merely obtained by angularly shifting said hinged forked profiles, which provide a sort of shoulder for the reed, without having to displace the already formed fabric. The angular shift of the forked profiles, in fact compels the reed to be rotated about its own hinge pin and thus to approach the edge of the already woven fabric, nearer or farther, as required.

Then, according to another characteristic of the invention the control members for adjusting the positions of the set of forked profiles comprise a set of eccentrics, which cooperate with the forks of said set of forked profiles and are keyed all on the same shaft and supported by the fixed textile loom frame. The camshaft is rotated by a control cam which is resiliently held by a spring into contact with the profile of said cam and to which a pitman is hinged which acts upon the stem of a toothed rocker in mesh with a gear fastened to said camshaft.

The invention is now better explained with the aid of the accompanying drawings, which show a preferred embodiment reduced to practice, given by way of example only and without any limitation, inasmuch as technical and constructional changes can be introduced without departing from the scope of this invention.

Figure 2:
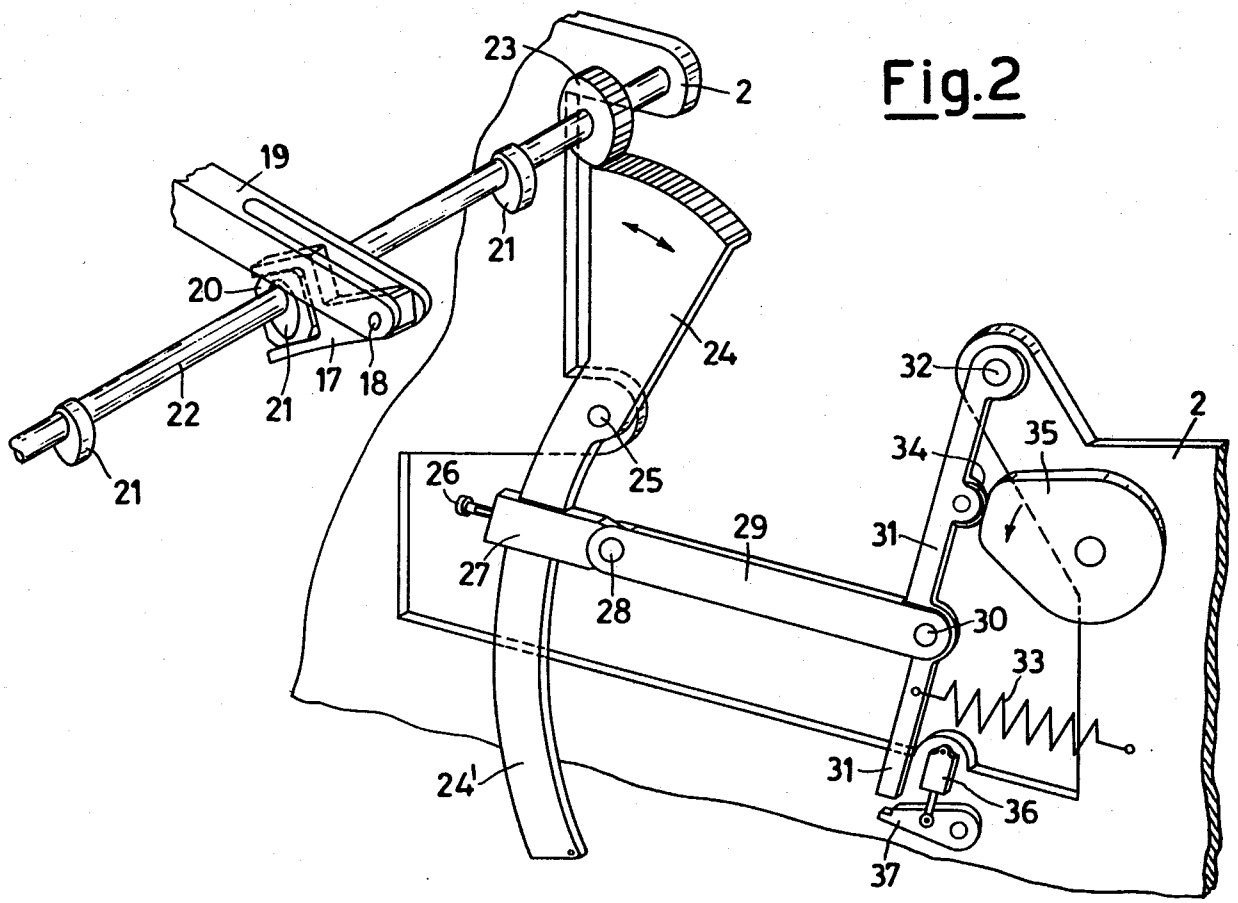

In the drawings:

FIG. 1 is a diagrammatical side-elevational view, partly in cross-section, of the device for varying the beating-up position of the reed according to the invention, as installed on a textile loom, and, FIG. 2 is a diagrammatical perspective close-up view of the control members intended to adjust the positions of the set of forked profiles of the device according to this invention.

With reference to the drawings, the numeral 1 indicates the sley which is hinged at the bottom portion to the fixed frame 2 of the loom by means of the axle 3 and supports on its overhead rod 4, the guide 5 for the weft-feeding needles. The numerals 6 and 7 indicate the warp threads which, together with the weft threads (not shown) make up the fabric 8.

The reed 9 of the loom is rigidly mounted on the top portion of a supporting member 10 which is hinged at 11 to the overhead rod 4 of the sley.

From the bottom portion of the supporting member 10, a set of arcuate feelers 12 and a corresponding set of arms 13 extend in opposite directions. Each arm 13 is connected to the fixed frame 2 of the loom by a spring 14 so that the arcuate feelers 12 are maintained with their resting followers 15, which are pivotally mounted at 16 to the free ends of the feelers 12, in constant contact with the forked profile 17.

The forked profiles 17 are pivoted about pins 18 on corresponding stirrups 19 which are a part of the rigid frame 2 of the loom A. Block 20 is mounted within each fork includes a bore within which an eccentric 21 is allowed to rotate.

All the eccentrics 21 of the forked profiles 17 are keyed to a single shaft 22 which is supported for rotation by the fixed loom frame 2.

To either end of the shaft 22, a gear 23 is then keyed, which is in mesh with a toothed rocker 24. The rocker 24 is pivotally mounted at 25 to the fixed frame 2 of the loom.

A block 27 is adjustably mounted on the stem 24' of the toothed rocker 24 by the set screw 26. The block 27 is pivoted about a pin 28 coupled to the end of a connecting rod 29. The opposite end of the rod 29 is pivoted about the pin 30 which is also coupled to a lever 31.

The lever 31 is fulcrumed at 32 to the fixed frame of the loom and is compelled by the spring 33 to keep its rolling follower 34 in constant contact with the control cam 35, which is rotatably supported by the frame 2 and is driven by means not shown in the drawings.

FIG. 2 also shows an electromagnetic armature 36 which can be used for rotating upwards the latching hook 37 so as to latch the lever 31 in the position which corresponds to the reed in the advanced position towards the fabric edge, that is, in the beating up position proper for weaving ordinary fabrics. The operation is as follows:

As the control cam 35 makes a revolution starting from the position shown in FIG. 2, due to the bias of the spring 33, the lever 31, and thus also the connecting rod 29 are shifted towards the right. This motion causes a counterclockwise rotation of the toothed rocker 24 and consequently a clockwise rotation of the shaft 22.

The eccentrics 21 of shaft 22 cause, the forked profiles 17 to be rotated downwards and cause the reed 9 to be rotated forwards towards the edge of the fabric 8, in the position shown in solid lines in FIG. 1 and corresponding to the beating-up proper of the weft threads.

As the control cam 35 is conversely restored to the position shown in FIG. 2, the reed 9 is rotated backwards to the position 9' shown in phantom in FIG. 1 and corresponding to that in which the weft threads which have been picked are approached to the edge of the woven fabric 8.

Summing up, by controlling the control cam 35 so that it is rotated from the position of FIG. 2 every two or three pickings, it is thus possible to obtain the formation of the terry in the Turkish towelling.

On the other hand, it should be borne in mind that the possibility of varying the position of latching of the block 27 on the stem 24' of the toothed rocker 24, permits varying the width of the rotation of the toothed rocker 24 when operated by the control cam 35 and enables the reed 9 to be positioned at leisure in a plurality of positions.

What I claim is:

1. A device for varying the beating-up position of the reed in textile looms used for the manufacture of Turkish towelling, in which the reed is mounted hingedly on the loom sley, comprising:

a set of feeler members mounted integrally with the hinged reed, a set of forked profiles which are hinged to the fixed loom frame, resilient means urging the feeler members into continuous contact with the forked profiles, and, control means for adjusting the position of the forked profiles to vary the beating-up position of the reed.

2. A device according to claim 1 wherein:

the control means for adjusting the position of the forked profiles comprises a shaft rotatably mounted to the fixed loom frame, and having a set of eccentrics mounted thereon which engage the forked profiles, a control cam for rotating said shaft and coupling means for adjustably connecting the cam to the shaft.

3. A device according to claim 2 wherein:

the coupling means comprises a lever, spring means urging the lever into engagement with the control cam, a connecting rod pivotally mounted to the lever, a toothed rocker having a downwardly extending stem, a block pivotally mounted to one end of the connecting rod and being adjustably connected to the stem of the toothed rocker and gear means mounted on the shaft and engaged by the toothed rocker.

4. A device according to claim 2 wherein:

the coupling means comprises a lever, spring means mounted to the frame and urging the lever into engagement with the control cam, a connecting rod pivotally mounted to the lever, a toothed rocker having a downwardly extending stem, a block pivotally mounted to one end of the connecting rod and being adjustably connected to the stem of the toothed rocker and gear means mounted on the shaft and engaged by the toothed rocker, and, latching means for locking the lever in a predetermined position corresponding to a particular fabric weave.

* * * * *

UNITED STATES PATENT AND TRADEMARK OFFICE

CERTIFICATE OF CORRECTION

PATENT NO. : 4,099,546
DATED : July 11, 1978
INVENTOR(S) : Nicola Santucci

It is certified that error appears in the above-identified patent and that said Letters Patent are hereby corrected as shown below:

Col. 1, line 64, After "being" delete --the--.

Col. 3, line 3, Correct "loom A. Block" to read

--loom. A block--.

line 4, After "fork" insert --and--.

line 38, Correct "cause," to read --cause--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*